US005783801A

United States Patent [19]

Riti et al.

[11] Patent Number: 5,783,801

[45] Date of Patent: Jul. 21, 1998

[54] SEAL FOR SEALING AND AUTOMATICALLY CLEANING A SHEATHED ELEMENT OF A HEATER PLUG FOR DIESEL ENGINES

[75] Inventors: Gianfranco Riti, Milan; Claudio Tonelli, Modena, both of Italy

[73] Assignee: Cooper Industries, Inc., Houston, Tex.

[21] Appl. No.: 655,441

[22] Filed: May 30, 1996

[30] Foreign Application Priority Data

May 31, 1995 [IT] Italy ..... T0950127 U

[51] Int. Cl.[6] ..... F23Q 7/32

[52] U.S. Cl. ..... 219/270; 219/270; 219/257; 338/238; 338/240

[58] Field of Search ..... 219/270, 257, 219/544, 541, 542; 338/238, 239, 240, 241, 242, 276, 277, 322; 123/145 A; 361/264, 266; 29/614, 615, 616, 617

[56] References Cited

U.S. PATENT DOCUMENTS

| | | | |
|---|---|---|---|
| 2,617,001 | 11/1952 | Hasley | 338/238 |
| 4,314,401 | 2/1982 | Saku | 29/611 |
| 4,636,614 | 1/1987 | Itoh | 361/266 |
| 4,963,717 | 10/1990 | Woelfle | 219/270 |

FOREIGN PATENT DOCUMENTS

| | | |
|---|---|---|
| 0365258 | 4/1990 | European Pat. Off. . |
| 8427789 | 1/1986 | Germany . |

*Primary Examiner*—Teresa J. Walberg
*Assistant Examiner*—Quan Nguyen
*Attorney, Agent, or Firm*—Fish & Richardson P.C.

[57] ABSTRACT

A sheathed element for a heater plug for diesel engines includes a hollow metal sheath that is open at one end, has a closed opposite end, and defines a cavity. A heating element is positioned in the cavity and the cavity is filled with insulating powder. An elastomeric seal is positioned in the open end of the sheath. The seal has an annular projection that projects from a surface of the seal and establishes a sealing contact with a respective seat of the sheath so that, when the seal is inserted into the seat, the projection removes particles present on an internal wall of the seat.

4 Claims, 2 Drawing Sheets

SEAL FOR SEALING AND AUTOMATICALLY CLEANING A SHEATHED ELEMENT OF A HEATER PLUG FOR DIESEL ENGINES

BACKGROUND OF THE INVENTION

The invention relates to a sheathed element for a heater plug for diesel engines.

A heater plug may include a hollow metal sheath which is open at one end, has a closed, arched opposite end, and defines a cavity. A heating element in the form of a metal coil is disposed in the cavity of the sheath, and the cavity is filled with an insulating powder. The open end of the cavity is closed by an elastomeric seal.

SUMMARY OF THE INVENTION

The invention features a heater plug having a sheathed element with an improved seal. In such a heater plug, the elastomeric seal must be an electrical insulator and must provide a perfect seal against infiltration of air into the sheathed element. The seal must be provided even at temperatures of 90°–120° C., as these temperatures may occur at the elastomeric seal when the heater plug is in operation.

The prevention of air infiltration into the sheathed element is a primary factor in increasing the reliability of the sheathed element. The seal is achieved mainly as a result of three factors: (1) suitable pressure exerted by the elastomeric seal against the internal wall of the sheath, (2) absence in the seal seats of scoring and roughness of dimensions comparable to those of the seal, and (3) absence of impurities and dust particles in the seal seats.

The first two requirements may be satisfied by using appropriate design parameters, by adopting suitable working techniques, and by effective control operations. However, the third requirement presents a process problem. The elimination of dust from the seal seat is a significant problem since dust particles positioned between the wall and the seal create paths through which air may pass.

As noted above, the interior of the sheath is filled with insulating powder (typically magnesium or aluminum oxide) which has the function of electrically insulating the heating element and readily conducting the heat produced by the element to the exterior of the sheath. The sheath is filled with such powder by passing the powder through the seal seat, which inevitably results in particles of the powder being deposited on the walls of the seat.

Cleaning of the seal seat is a very difficult operation. Insertion of a small spatula or brush into the sheath is problematic due to the restricted size of the space. In addition, the surrounding parts are delicate and even a small alteration thereof involves large changes in the functional characteristics of the heater plug.

The invention overcomes these problems by providing a sheathed element that includes a seal having at least one annular projection. The projection projects from a surface of the seal and establishes a sealing contact with a respective seat of the sheath. When the seal is fitted into the seat, the projection removes dust particles present on the internal wall of the seat as the projection moves along the internal wall of the sheath. This arrangement avoids a specific cleaning operation and prevents the risk of breakage of adjacent parts.

In one aspect, generally, the invention features a sheathed element for a heater plug for diesel engines. The sheathed element includes a hollow metal sheath that is open at one end, has a closed opposite end, and defines a cavity. A heating element (e.g., a metal coil) is positioned in the cavity, and the cavity is filled with insulating powder. An elastomeric seal is positioned in the open end of the sheath. The seal has an annular projection that projects from a surface of the seal and establishes a sealing contact with a respective seat of the sheath so that the projection removes particles present on an internal wall of the seat when the seal is inserted into the end of the sheath.

Embodiments may include one or more of the following features. The sheathed element may also include a rod that supplies an electric current to the heating element. The seal may be annular and may have an internal surface that establishes a sealing contact with an outer surface of the rod. The seal may also have at least one projection projecting from the internal surface.

Other features and advantages will become apparent from the following description, including the drawings, and from the claims.

DESCRIPTION OF THE PREFERRED EMBODIMENTS

Figure 1:
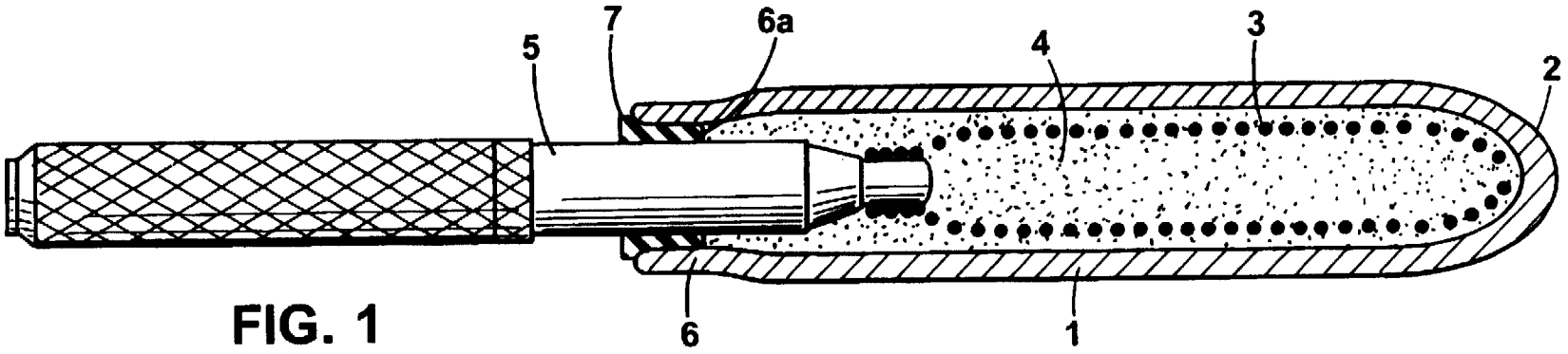
FIG. 1 is a schematic, axial section of a sheathed element.

FIG. 1 shows a sheathed element of a glow plug for a diesel engine. The sheathed element includes a sheath 1 formed by a hollow metal tube having a closed, arched end 2. A heating element 3 is positioned inside sheath 1. The heating element 3 includes a metal coil connected electrically to the end 2 of the sheath 1.

The interior of sheath 1 is filled with an insulating powder 4 such as, for example, magnesium or aluminum oxide powder. The insulating powder has the functions of electrically insulating the heating element 3 from the sheath 1 and conducting heat produced by the glowing coil to the exterior of the sheath 1. The heating element 3 receives electric current from a cylindrical rod 5 that extends through an open end 6 of the sheath 1.

The open end 6 of the sheath 1 has a seat *6a* for a sealing ring 7. The sealing ring 7 is made of elastomeric material, such as, for example, hard rubber.

Figure 4:
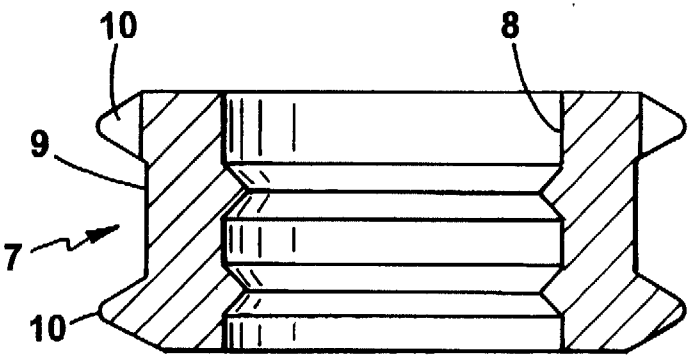
Fig. 4 is a sectional view of an alternative embodiment of the seal of FIG. 2.
Figure 2:
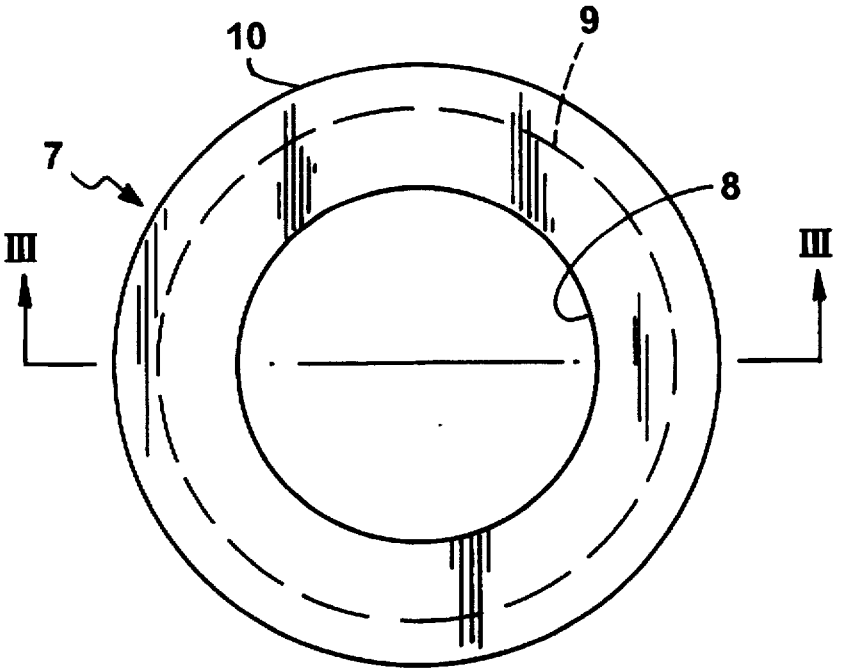
FIG. 2 is a plan view of a seal of the sheathed element of FIG. 1.
Figure 3:
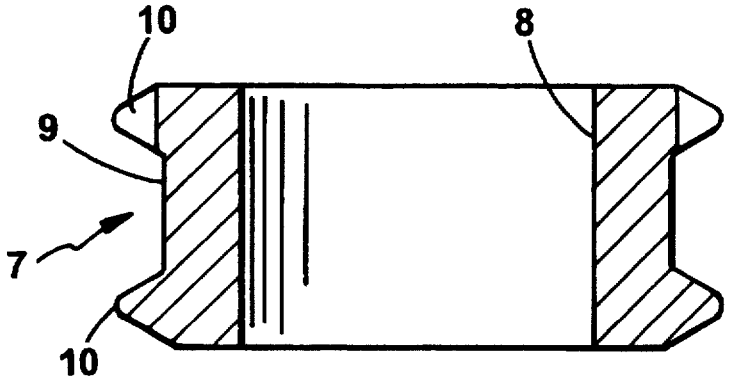
FIG. 3 is a sectional view of the seal of FIG. 2 taken on the section III—III of FIG. 2.

As can be seen in greater detail in FIGS. 2 and 3, the sealing ring 7 has an internal surface 8 that establishes a sealing contact with the rod 5. The sealing ring 7 also has an external surface 9 which has a diameter sized to be fitted with radial interference in the seat *6a*. Two annular projections 10 with substantially triangular profiles project from the external surface 9 and exert a vigorous cleaning effect on the seat *6a* when the sealing ring 7 is inserted into the open end 6 of the sheath. Similar projections such as the projections 40 of FIG. 4, may be provided on the internal surface 8 of the seal so as also to achieve a cleaning effect on the external surface of the rod 5.

Other embodiments are within the following claims.

What is claimed is:

1. A sheathed element for a heater plug for diesel engines, comprising:

a hollow metal sheath that is open at one end, has a closed opposite end, and defines a cavity;

a heating element positioned in the cavity;

insulating powder filling the cavity; and an elastomeric seal positioned in the open end of the sheath, the seal having an annular projection that projects from a surface of the seal prior to insertion of the seal into the open end of the sheath, the projection establishing a sealing contact with a respective seat of the sheath so that the projection removes particles present on an internal wall of the seat when the seal is inserted into the open end of the sheath.

2. The sheathed element of claim 1, further comprising a rod that supplies an electric current to the heating element, wherein the seal is annular and has an internal surface that establishes a sealing contact with an outer surface of the rod.

3. The sheathed element of claim 2, wherein the seal has at least one projection projecting from the internal surface.

4. The sheathed element of claim 1, wherein the heating element comprises a metal coil.

* * * * *